United States Patent [19]

Estebanez et al.

[11] 4,048,956

[45] Sept. 20, 1977

[54] APPARATUS FOR TREATING A SURFACE

[75] Inventors: Joseph Estebanez, Upton-by-Chester, England; David V. Harrison, Flint, Wales; Clifford P. Jones, Ellesmere Port; Wirral; Henry G. E. Wilson, Chester, both of England

[73] Assignee: Shell Internationale Research Maatschappij B.V., Netherlands

[21] Appl. No.: 674,489

[22] Filed: Apr. 7, 1976

[30] Foreign Application Priority Data

June 4, 1975 United Kingdom ..... 24100/75

[51] Int. Cl.[2] ..... B05B 13/06

[52] U.S. Cl. ..... 118/306; 114/222; 118/323; 239/172

[58] Field of Search ..... 118/323, 305, 306, 315, 118/317, 321, 631, 108, 207, 214, 215; 134/172, 180; 114/222; 239/146, 172, 178

[56] References Cited

U.S. PATENT DOCUMENTS

| | | | |
|---|---|---|---|
| 667,369 | 2/1901 | Redman | 118/323 X |
| 1,281,407 | 10/1918 | Marquess | 118/323 X |
| 3,274,860 | 9/1966 | Gauthier et al. | 118/323 X |
| 3,623,902 | 11/1971 | Hammelmann | 118/323 X |
| 3,783,819 | 1/1974 | Hammelmann | 118/305 |
| 3,989,006 | 11/1976 | Estebanez et al. | 118/306 |

FOREIGN PATENT DOCUMENTS

| | | | |
|---|---|---|---|
| 354,899 | 1/1968 | U.S.S.R. | 118/323 |

*Primary Examiner*—Louis K. Rimrodt

*Attorney, Agent, or Firm*—Pravel, Wilson & Gambrell

[57] ABSTRACT

Apparatus for treating a surface comprising a first frame adapted to be moved across the surface to be treated, a sliding frame mounted on and adapted to slide relatively to the first frame in a direction perpendicular to the surface to be treated, an adjustable frame mounted on and adapted to be adjusted relatively to the sliding frame in a direction perpendicular to the surface to be treated, a tool carrier mounted on the adjustable frame and means for maintaining the sliding frame at substantially a predetermined distance from the surface to be treated.

4 Claims, 3 Drawing Figures

APPARATUS FOR TREATING A SURFACE

BACKGROUND OF THE INVENTION

The invention relates to an apparatus and to a method for treating a surface, in particular for spraying an insulating foam, for example a polyurethane foam, on a wall of a tank. Examples of such tanks are the tanks present in seagoing tankers for transorting liquefied gases (natural gas, methane, propane).

In this specification the expression "treating a surface" is intended to include a number of operatons, viz. spraying an insulating foam onto a surface, for example, pojyurethane foam, spraying a paint onto a surface, spraying an anti-corrosion material onto a surface, cleaning a surface, sandblasting a surface, and even rolling a surface. Similarly, the expression "treating tool" is intended to include, a spraying tool, a cleaning tool, a sandblasting tool, a grinding tool, a laminating tool and rolling tool.

SUMMARY OF THE INVENTION

The apparatus according to the invention comprises a first frame adapted to be moved across the surface to be treated, a sliding frame mounted on and adapted to slide relatively to the first frame in a direction perpendicular to the surface to be treated, an adjustable frame mounted on and adapted to be adjusted relatively to the sliding frame in a direction perpendicular to the surface to be treated, a tool carrier mounted on the adjustable frame and means for maintaining the sliding frame at substantially a predetermined distance from the surface to be treated.

The tool carrier of the apparatus according to the invention is adapted to carry each of the tools as mentioned in the above, in dependence of the operation which has to be carried out.

Preferably the tool carrier is mounted on the adjustable frame in such a manner that its position can be adjusted relatively to the adjustable frame in a direction parallel to the surface to be treated.

In a suitable embodiment of the apparatus according to the invention the means for maintaining the sliding frame at substantially a predetermined distance from the surface to be treated comprise surface following means carried by the sliding frame and cooperating with adjusting means arranged between the first frame and the sliding frame.

In an attractive embodiment of the apparatus according to the invention the surface following means comprise a roller, a foot or a similar device which is adapted to be maintained in contact with the surface to be treated.

The apparatus according to the invention has the advantage that the abovementioned operations can be carried out in a highly mechanized way so that work of high quality and substantial savings in labor costs are obtained.

DETAILED DESCRIPTION OF THE PREFERRED EMBODIMENT

Figure 1:
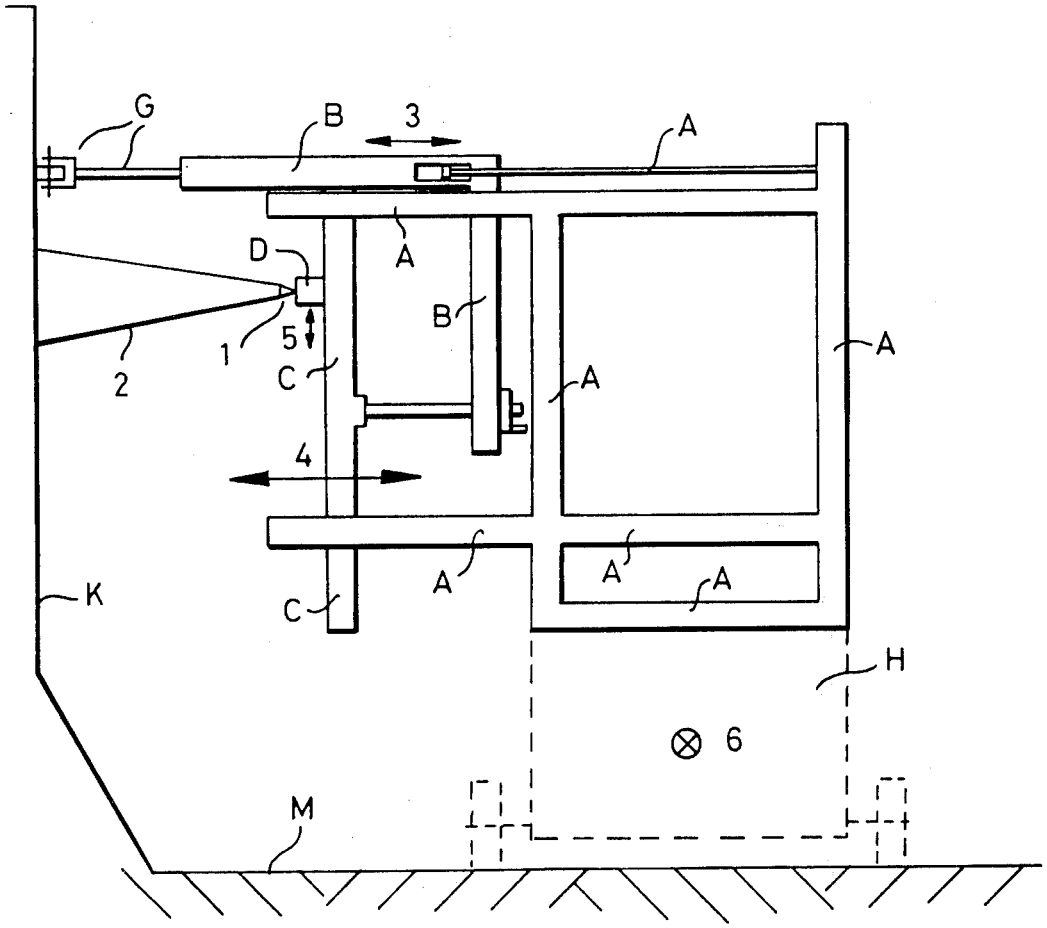
FIG. 1 shows a side view of the basic elements of the apparatus according to the invention.

In FIG. 1 the basic elements of the apparatus according to the invention are shown schematically. It comprises a first frame A adapted to be mounted on a suitable carriage H (indicated by dotted lines) which is, for example, adapted to a ride along the floor M. The surface to be treated is, for example, a vertical wall K and the carriage H is so constructed that it is suitable for moving the frame A across the surface K, for example by moving the carriage H along the floor M in the direction indicated by arrow 6.

On the first frame A a sliding frame B is mounted in such a manner that frame B can slide relatively to the first frame A in a direction (indicated by arrow 3) perpendicular to the surface K. On the sliding frame B an adjustable frame C is mounted in such a manner that it is adjustable relatively to the sliding frame B in a direction (indicated by arrow 4) perpendicular to the surface K. Furthermore frame B is provided with means G for maintaining the sliding frame B at substantially a predetermined distance from the surface K.

A tool carrier D is mounted on the adjustable frame C in such a manner that its position can be adjusted relatively to the adjustable frame C in a directon (indicated by arrow 5) parallel to the surface K.

In FIG. 1, the tool carrier D is provided with a spraying head 1, for example for spraying polyurethane foam onto the surface K, the spray cone being indicated by reference numeral 2.

Figure 2:
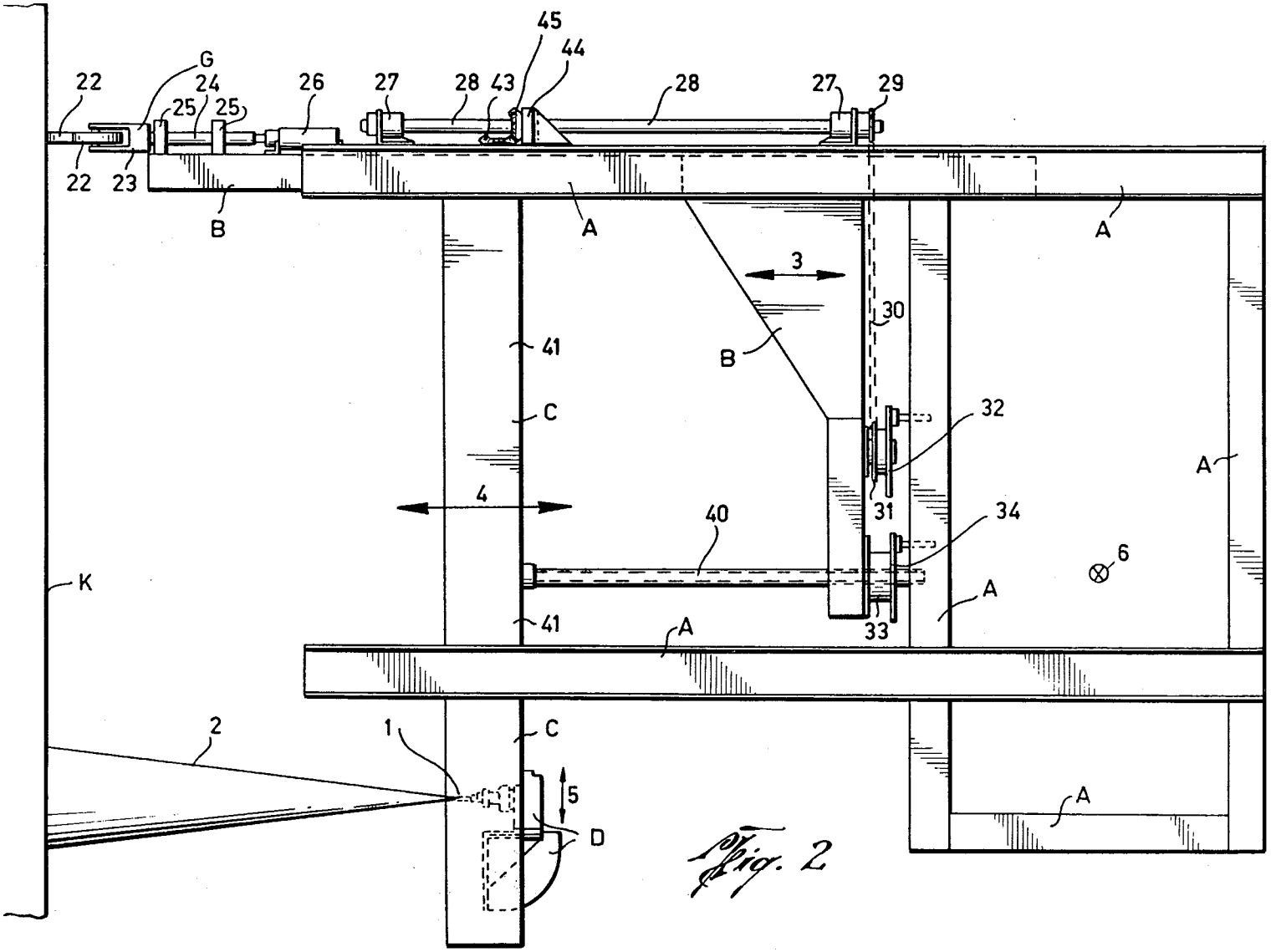
FIG. 2 shows more in detail a side view of the apparatus according to the invention.
Figure 3:
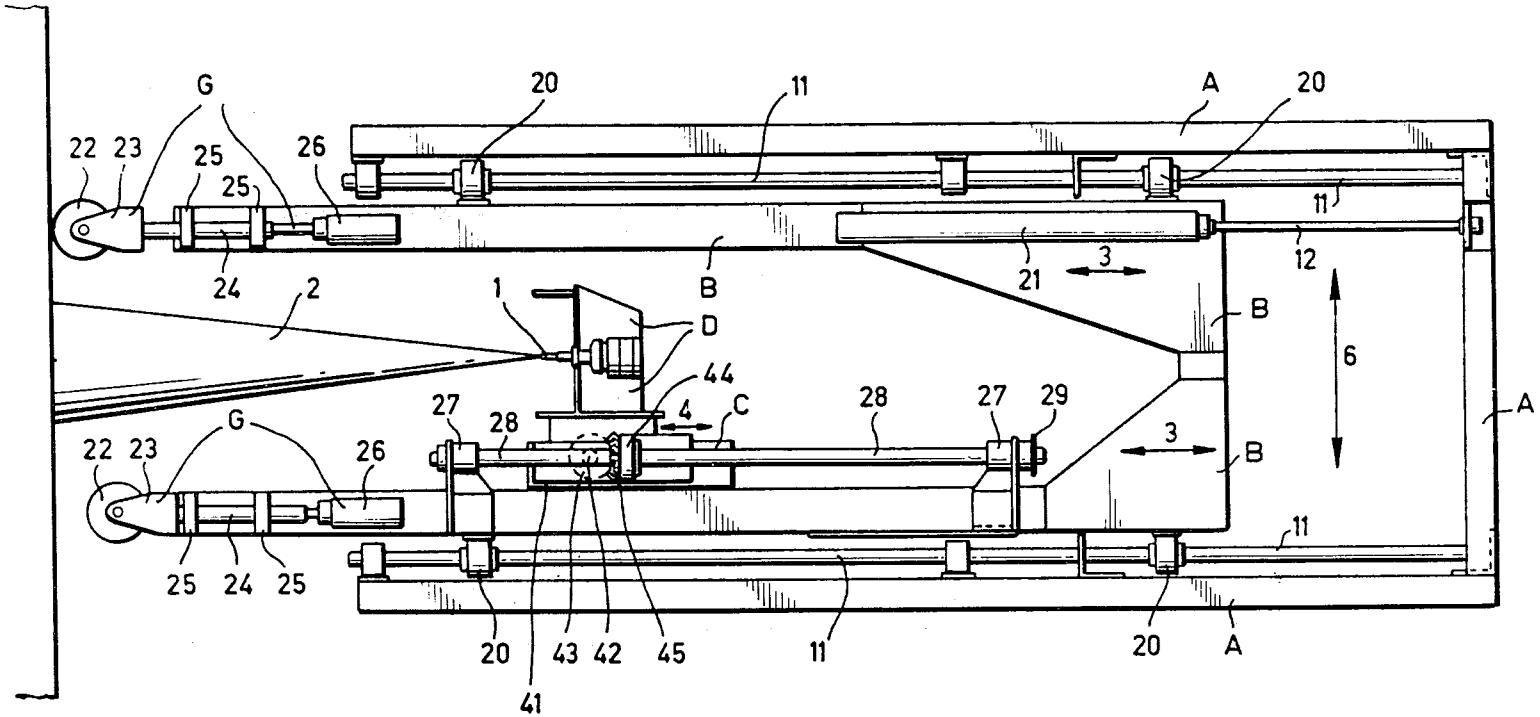
FIG. 3 shows a top plan view of the detailed apparatus according to FIG. 2.

The apparatus according to the invention will now be described more in detail with reference to FIGS. 2 and 3.

The first frame A is provided with a pair of guide bars 11 which are fixedly secured to frame A. On the frame A is mounted the sliding frame B. The sliding frame B is provided with a number of guide elements 20 having openings through which the guide bars 11 pass. The guide bars 11 and the guide elements 20 are so arranged that they cooperate in such a manner that the sliding frame B is allowed to be displaced relatively to the first frame A and along the guide bars 11 in a direction (indicated by arrow 3) which is perpendicular to the surface K which has to be treated.

The sliding frame B is provided with an air cylinder 21. Within the air cylinder 21 a piston (not shown) is arranged, said piston being secured to one end of a shaft 12. The other end of the shaft 12 is fixed to the first frame A.

In the embodiment shown the means G for maintaining the sliding frame B at substantially a predetermined distance from the wall K comprise a roller 22, a fork 23 fixed to a shaft 24, the latter passing through guide elements 25 which are fixed to sliding frame B and which allow the shaft 24 to be displaced in longitudinal direction.

The opposite end of the shaft 24 carries a piston (not shown) which is adapted to slide in a hydraulic cylinder 26. By means of the hydraulic cylinder 26 the distance of the roller 22 from the sliding frame B can be adjusted at will.

On the sliding frame B, a pair of bearings 27 is mounted. These bearings 27 carry a spindle 28 in such a manner that it is free to rotate around its longitudinal axis. A chain-wheel 29 is fixed on the spindle 28. The chain-wheel 29 is connected by means of a chain 30 to a second chain-wheel 31. The chain-wheel 31 is mounted on the sliding frame B in such a manner that it can be rotated by a hand-wheel 32. In other words by rotating the hand-wheel 32, it is possible to rotate the spindle 28.

The adjustable frame C is mounted on the sliding frame B in such a manner that it can be adjusted relatively to the sliding frame B in a direction (indicated by arrow 4) perpendicular to the surface K. In order to adjust the adjustable frame C, one end of a lead-screw 40 is fixed to the frame C. The lead-screw 40 cooperates with a nut 33 which is rotatably mounted on the sliding frame B and which is adapted to be rotated by a hand-wheel 34. By this arrangement, it is possible to displace the adjustable frame C in the direction indicated by arrow 4 by rotating the hand-wheel 34.

The tool carrier D is mounted on the adjustable frame C in such a manner that it can be displaced along the vertical beam 41 of frame C, as indicated by the arrow 5.

For this purpose a lead-screw 42 is mounted on, and arranged parallel to, the beam 41 in such a manner that the lead-screw 42 can be rotated around its longitudinal axis. The lead-screw 42 is adapted to cooperate with a fixed nut (not shown) which is mounted on the tool-carrier D, so that rotation of the lead-screw 42 will cause the tool-carrier D to be displaced along the vertical beam 41. A bevel gear 43 is fixed on the lead-screw 42. A bearing 44 is fixed on the adjustable frame C, said bearing 44 being adapted to support a bevel gear 45 in such a manner that it is rotatable. The bevel gears 43 and 45 are adapted to cooperate. The spindle 28 is provided with a key (not shown) which extends along the entire length of the spindle 28. Said key cooperates with the bevel-gear 45 in such a manner that the bevel-gear 45 can be displaced along the spindle 28 and that in any position of the bevel-gear 45 rotation of the spindle 28 will cause rotation of the bevel gear 45. By means of this arrangement, it is possible to displace the tool-carrier D in the direction indicated by the arrow 5 by rotating the hand-wheel 32.

The operation of the apparatus according to the invention is as follows. Assume that it is desired to treat the surface K, for example by spraying a material, for example polyurethane foam, onto the surface K. The first frame A is positioned at a certain distance from the surface K, as shown in the drawings. The adjustable frame C is adjusted by turning the handwheel 34 so that the frame C is displaced towards or away from the surface K until the spraying nozzle 1 is at the proper distance from the surface K. Then one of the rollers 22 is moved towards the surface K by means of the corresponding hydraulic cylinder 26 until said roller 22 contacts the surface K. Finally the whole apparatus is caused to be moved along the surface in the direction indicated by the arrow 6, for example by displacing the carriage H, which for this purpose may run along rails (not shown) which are parallel to the surface K. During this movement of the apparatus the spraying tool sprays material, for example polyurethane foam, onto the surface. In this manner a horizontal strip of material will be sprayed onto the surface K. When this strip has been completed, the spraying tool D is displaced over a predetermined distance in a vertical direction (see arrow 5) by rotating the hand-wheel 32. Then the whole operation is repeated, so that a next strip of material is sprayed onto the surface K, and so on, until the whole operation is repeated, so that a next strip of material is sprayed onto the surface K, and so on, until the whole surface K has been covered with the material. If desired a number of layers of the material may be sprayed on top of each other until the desired thickness of material on the surface K has been obtained.

During the above-mentioned displacement of the apparatus along the surface K, the roller 22 will be in continuous contact with, and ride over, the surface K. This contact of the roller 22 is ensured by the air cylinder 21 cooperating with the said piston (not shown) and shaft 12. This arrangement will act as a compression spring biasing the sliding frame B towards the surface K. Even if the surface K is not completely flat, the roller 22 will follow the irregularities of the surface K and will ensure that the sliding frame B together with the spraying tool 1 will always be kept at the desired distance from the surface K to be treated. Of course, it is possible to use, instead of the air cylinder 21, piston and shaft 12, alternative means for keeping the sliding frame B at the desired distance from the surface K to be treated. Such alternative means may comprise suitable detecting means (for example electronic, fluidic or sonic) for measuring the distance of the frame B to the surface K, wherein the signals produced are used for correcting the position of the frame B relative to the surface K in such a manner that the frame B is always maintained at a predetermined distance from the surface K.

In the embodiment shown in the drawings two rollers 22 are shown. During a spraying operation preferably only one of the two rollers 22, viz. the one which moves in front of the spraying cone 2, is kept in contact with the surface K, the other roller being kept away from the surface K, as shown in FIG. 3. In this manner the chance of material being sprayed onto the roller 22 is reduced to a substantial degree. Of course it is possible to keep both rollers 22 in contact with the surface K at the same time during the operation. However, especially during spraying operations, it is preferred to use only one roller 22.

We claim:

1. Apparatus for treating a surface, comprising:

a first frame adapted to be moved across the surface to be treated, a sliding frame mounted on and adapted to slide linearly relatively to said first frame in a direction perpendicular to the surface to be treated, an adjustable frame mounted on and adapted to be adjusted linearly relatively to said sliding frame in a direction perpendicular to the surface to be treated, a tool carrier mounted on said adjustable frame in such a manner that the position of said tool carrier can be adjusted relatively to said adjustable frame in a direction parallel to the surface to be treated, and means for maintaining said sliding frame at substantially a predetermined distance from the surface to be treated, which means comprise surface following means carried by said sliding frame and cooperating with said adjusting means arranged between said first frame and said sliding frame.

2. The structure set forth in claim 1, wherein said surface following means comprise: foot means adapted to be mounted in contact with the surface to be treated.

3. The structure set forth in claim 2, wherein:

said sliding frame means is provided with two surface following means, and wherein said two surface following means are mounted on said sliding frame in such a manner that either one can be brought into contact with the surface to be treated at will.

4. The structure set forth in claim 1, wherein said adjusting means arranged between said first frame and said sliding frame are means for biasing said sliding frame towards the surface to be treated.

* * * * *